US008756901B2

(12) United States Patent
Carey

(10) Patent No.: US 8,756,901 B2
(45) Date of Patent: Jun. 24, 2014

(54) V-PACK

(76) Inventor: Vlad Carey, Los Angeles, CA (US)

( * ) Notice: Subject to any disclaimer, the term of this patent is extended or adjusted under 35 U.S.C. 154(b) by 834 days.

(21) Appl. No.: 12/928,369

(22) Filed: Dec. 10, 2010

(65) Prior Publication Data

US 2011/0138746 A1 Jun. 16, 2011

Related U.S. Application Data

(60) Provisional application No. 61/283,933, filed on Dec. 10, 2009.

(51) Int. Cl.
*B65B 61/22* (2006.01)
*B65B 55/20* (2006.01)

(52) U.S. Cl.
USPC ..... 53/415; 53/449; 53/452; 53/465

(58) Field of Classification Search
USPC ..... 53/415, 452, 465, 449
See application file for complete search history.

(56) References Cited

U.S. PATENT DOCUMENTS 3,641,725 A * 2/1972 Grisell ..... 53/412
3,805,473 A * 4/1974 Lidgard ..... 53/412
3,890,762 A * 6/1975 Ernst et al. ..... 53/440
3,943,682 A * 3/1976 Rausing ..... 53/415
3,968,620 A * 7/1976 Keltner ..... 53/434
4,002,003 A * 1/1977 Place et al. ..... 53/415
5,402,892 A * 4/1995 Jaszai ..... 206/522
5,624,035 A * 4/1997 Kim ..... 206/522
6,106,449 A * 8/2000 Wynne ..... 493/101
6,520,333 B1 * 2/2003 Tschantz ..... 206/522
7,389,627 B2 * 6/2008 Miles ..... 53/434
7,568,324 B2 * 8/2009 Bussey et al. ..... 53/86
7,861,494 B2 * 1/2011 Binner ..... 53/223
2009/0260327 A1 * 10/2009 Andria et al. ..... 53/436
2011/0023415 A1 * 2/2011 Davlin et al. ..... 53/396
2011/0180550 A1 * 7/2011 Kenneally ..... 220/592.2
2011/0309086 A1 * 12/2011 Arnitz et al. ..... 220/560.08
2012/0272621 A1 * 11/2012 Miyazaki et al. ..... 53/452

* cited by examiner

*Primary Examiner* — Hemant M Desai
*Assistant Examiner* — Gloria R Weeks
(74) *Attorney, Agent, or Firm* — Ruth Eure

(57) ABSTRACT

The present invention provides an improved packaging method and apparatus. An item enclosed in the V-Pack is shipped or stored in such a way that there is no extra space inside. This is accomplished by specially formulated foam included in each box. In this manner, internal damage to goods is rendered impossible. In addition, an extra layer of foam protects the item or items from damage by external elements, such as moisture and extreme cold or warm temperatures. Any excess air inside the chamber where the items are located, is removed by an external pump, creating a vacuum effect, which provides for the item's safe storage conditions. To facilitate the vacuum action, a valve is provided in two sections on the packaging box.

2 Claims, 2 Drawing Sheets

V-PACK

CLAIM OF PRIORITY

This patent application claims priority under 35 USC 119 (e) (1) from U.S. Provisional Patent Application Ser. No. 61/283,933 filed Dec. 10, 2009, of common inventorship herewith entitled, "V-Pack."

FIELD OF THE INVENTION

The present invention pertains to the field of packing boxes, and more specifically to the field of built-in protective packing boxes.

BACKGROUND OF THE INVENTION

The prior art has put forth several designs for built-in protective packing boxes. Among these are:

U.S. Pat. No. 5,481,852 to Jerry L. Mitchell describes the method and apparatus for exchanging gases contained within a sealed container is disclosed, said system comprising a pressurizable housing through which sealed container is passed, means to affix a valve to said container and means to exchange gases through said valve.

US Patent Application 20060108256 to Buddy Harry Bussey III and Harry Bussey Jr. describes a package made of cardboard with one or more plastic envelopes laminated to at least the side walls of the package. The envelopes are inflated from without the carton via a hollow needle that passes through a side wall of the package, and a glue spot adhering the envelope in place. Air, nitrogen, foamable material or polystyrene beads may pass through the hollow needle to inflate the envelope(s).

U.S. Pat. No. 4,142,665 to Steven R. Jewell and Albert R. Brown describes a container of the tray design which is formed of one piece of corrugated board, the container being particularly adapted for the packing of fruit, tomatoes and other fresh produce items. The container has triple laminated ends and is formed from a substantially rectangular blank with a minimum of waste. The laminated end panels are secured by sets of stripes of adhesive, one set being between each pair of end panels and the stripes of the two sets being in crossing relation. The end panels may be provided with stacking tabs and containing notches.

None of these prior art references describe the present invention.

SUMMARY OF THE INVENTION

It is an object of the present invention to provide an improved vacuum packed packing box having foam insulation.

DETAILED DESCRIPTION OF THE INVENTION

Figure 2:
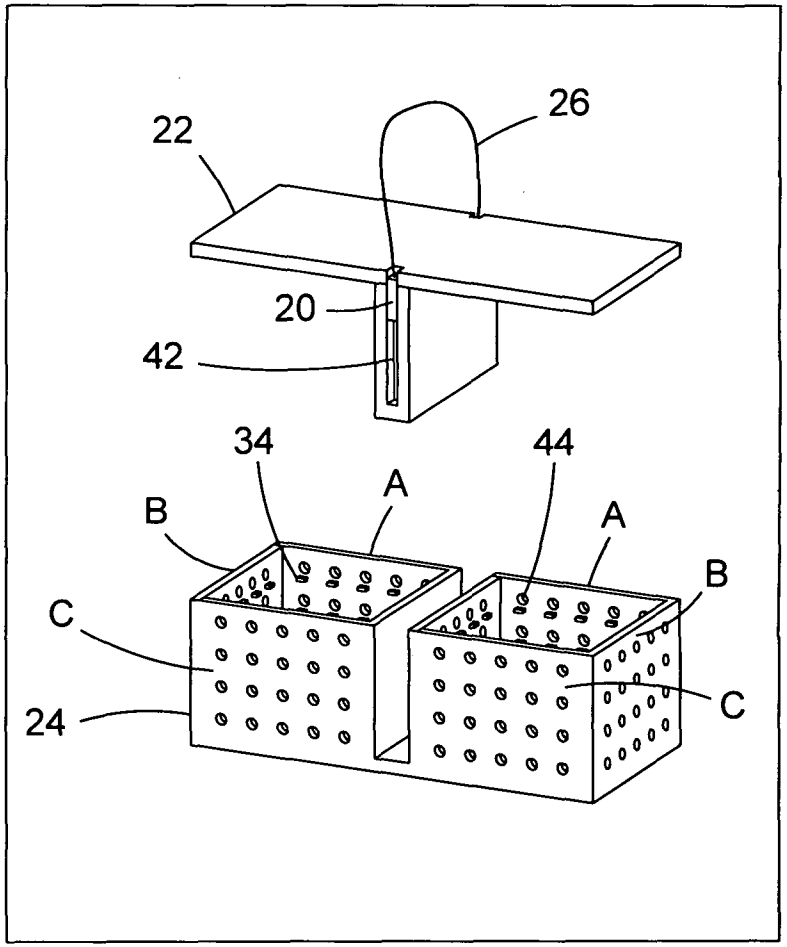
FIG. 2 is an elevational perspective view of a portion of the apparatus.
Figure 1:
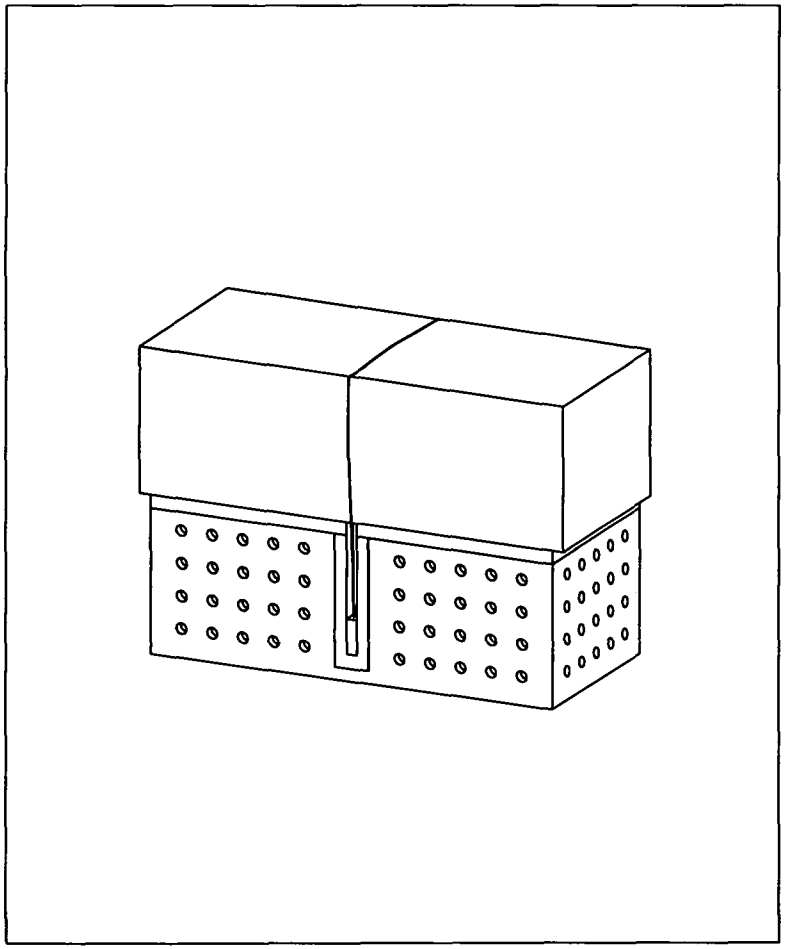
FIG. 1 is an elevational angled perspective view of the device of the present invention.
Figure 3:
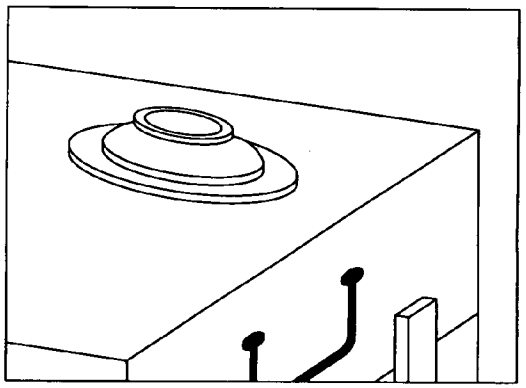
FIG. 3 is a close-up elevational perspective view of a portion of the device of the present invention.
Figure 5:
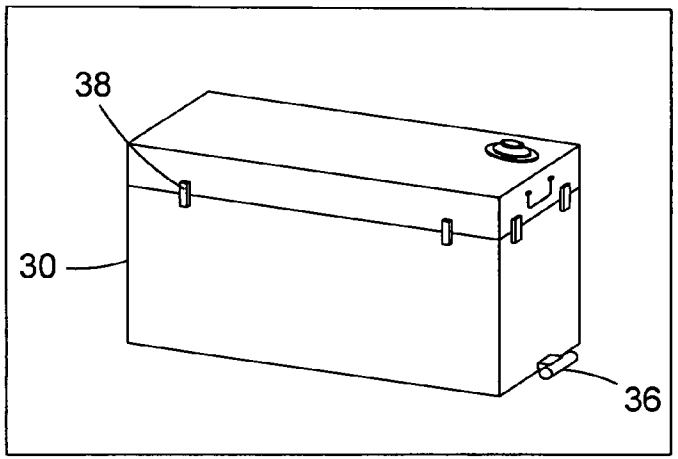
FIG. 5 shows the device of the present invention in its sealed configuration.
Figure 4:
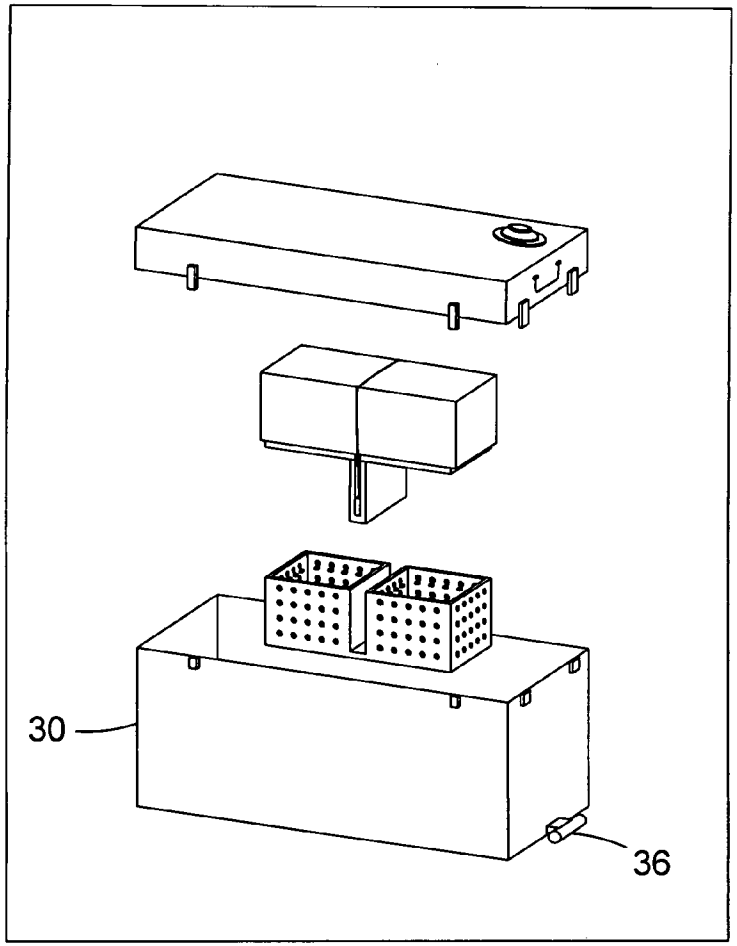
FIG. 4 shows an exploded view of the device of the present invention.

The present invention, hereinafter referred as the V-Pack is a specially designed enhancement to shipping packages that incorporates a handy means of vacuum-packing the material contained within, thereby ensuring that valuable items are not damaged during transport. The V-Pack, in its basic form, is essentially a rectangular box, offered in a wide variety of sizes to accommodate virtually any shipping needs.

An item enclosed in the V-Pack is shipped or stored in such a way that there is no extra space inside. This is accomplished by a specially formulated foam included in each box. In this manner, internal damage to goods is rendered impossible. In addition, an extra layer of foam protects the item or items from damage by external elements, such as moisture and extreme cold or warm temperatures. Any excess air inside the chamber where the items are located, is removed by an external pump, creating a vacuum effect, which provides for the item's safe storage conditions. To facilitate the vacuum action, a valve is provided in two sections on the packaging box, heretofore referred to as Stand 1 (22) and Stand 2 (24).

To utilize the V-Pack for packaging, an item being shipped or stored is wrapped in protective paper or fabric, then placed on the surface of Stand 1 (22). The item is further secured by a line/string (26) that is slightly pulled together, encircling the surface of this part, then a handle 20 located at the end of the line/string 26 into a provided slot 42, and a roller apparatus is then fixed into place. Stand 1 (22) and Stand 2 (24) are then connected and closed, and placed inside the box 30 together.

For further clarification, Stand 1 (22) is a T-shaped construction with an integrated roller, equipped with a constricting coil and the line/string 26. At the end of the line/string is a handle 20, which is inserted into a slot 42 provided on the opposite side of Stand 1 (22), thus surrounding the contours of the item that is being shipped/stored. Stand 1 (22) is then placed or inserted into Stand 2 (24). This second stand is also a connecting part, and opener with walls labeled A, B, and C, with spikes 34 for capturing the foam material. Additionally, these walls are perforated with holes 44 of a diameter large enough so that the foam material can seep through them and get behind the walls of Stand 2 (24).

At the bottom part of the box, a runner 36 is provided connecting the vacuum pump to the valve of Stand 2 (24). At the top part of the box, there is a runner to connect the container with the foam. The top and bottom parts of the box 30 are connected and closed hermetically by provided clasps/locks 38, and the foam is dispensed under a specific level of pressure. When the foam material solidifies, the vacuuming effect between Stands 1 (22) and 2 (24) is created by a pump, enabling the opening of Stand 1 (22) and the creation of the vacuum within the entire inner space, where the item being stored or shipped is located. The top part of the box 30 is then removed, and the airtight package of foam material is pushed out. Next, a preprinted sticker, with an address or the product's brand, is placed at the bottom, atop the base of Stand 2 (24). For package opening, a central hook/handle is positioned underneath the sticker, and used to pull out Stand 2 (24) together with the foam material located inside the container. When accessing Stand 1 (22), the handle 20 is removed from the slot 42, which results in the foam material being separated by the line/string 26. The item is now ready to be removed from the box 30.

A very creative product invention that offers a revolutionary improvement on shipping packaging, the V-Pack ensures that valuable items are protected during the storage and shipping process. Eliminating the need to stuff boxes with sheets of newspaper or bubble wrap, this product ensconces virtually any item in a matter of minutes with its all-encompassing construction. Ideal for consumer use, The V-Pack is well received by small and large businesses alike, particularly Internet sellers who utilize such services as eBay and Amazon to purvey their goods. Recipients of a package shipped within a V-Pack are also very appreciative of the careful packaging of their orders.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A method and apparatus for protective package and shipping device, comprising:

wrapping an item being shipped or stored in protective paper of fabric;

placing the item on the surface of Stand 1, wherein Stand 1 comprises a T-shaped construction having an integrated roller and further having a constricting coil with a line or string tied around it, further comprising a handle at the end of the string, thus surrounding the contours of the item, wherein the item is further secured by a line or string that is slightly pulled together, encircling the surface of this item, then inserting a handle located at the end of the line or string into a provided slot located on the opposite side of Stand 1, and a roller apparatus is then fixed into place;

connecting and closing Stand 1 and Stand 2 and placing inside a box together, wherein Stand 2 is a connecting part, and opener with walls labeled A, B, and C, having spikes for capturing foam material which is injected into the box; wherein the walls of Stand 2 are perforated with holes of a diameter large enough so that foam material can seep through them and get behind the walls of Stand 2; further; a runner at the bottom part of the box is provided connecting a the vacuum pump to the valve of Stand 2, and wherein the top part of the box comprises a runner to connect the container with the foam; and wherein the top and bottom parts of the box are connected and closed hermetically by provided clasps or locks, and the foam is dispensed under a specific level of pressure, wherein when the foam material solidifies, the vacuuming effect between Stand 1 and Stand 2 is created by a pump, enabling the opening of Stand 1 and the creation of the vacuum within the entire inner space, where the item is located; and wherein the top part of the box is then removed, and the airtight package of foam material is pushed out; further a preprinted sticker, with an address or the product's brand, is placed at the bottom, atop the base of Stand 2.

2. A method of opening the package of claim 1, comprising positioning a central hook and handle is positioned underneath the sticker, and used to pull out Stand 2 together with the foam material located inside the container; wherein the handle is removed from the slot when accessing Stand 1, which results in the foam material being separated by the line or string thereby releasing the item which is now ready to be removed from the box.

* * * * *